US005424611A

United States Patent [19]

Moriarty, Jr.

[11] Patent Number: 5,424,611

[45] Date of Patent: Jun. 13, 1995

[54] METHOD FOR PRE-HEATING A GAS-DISCHARGE LAMP

[75] Inventor: John K. Moriarty, Jr., Reading, Pa.

[73] Assignee: AT&T Corp., Murray Hill, N.J.

[21] Appl. No.: 172,363

[22] Filed: Dec. 22, 1993

[51] Int. Cl.[6] ..... H05B 39/00

[52] U.S. Cl. ..... 315/94; 315/209 R; 315/224; 315/307; 315/DIG. 5; 315/DIG. 7; 315/106

[58] Field of Search ..... 315/94, 106, 302, 307, 315/200 R, 209 R, 224, DIG. 5, DIG. 7

[56] References Cited

U.S. PATENT DOCUMENTS

| | | | |
|---|---|---|---|
| 4,949,013 | 8/1990 | Zuchtriegel | 315/106 |
| 4,952,842 | 8/1990 | Bolhuis et al. | 315/106 |
| 5,049,790 | 9/1991 | Herfurth et al. | 315/DIG. 4 X |
| 5,122,712 | 6/1992 | Hirschmann | 315/106 |

OTHER PUBLICATIONS

"Telefunken Application Note", (Date Unknown) pp. 1 through 6.

"Electronic Ballasts", *PCIM*, Apr. 1987, R. J. Haver, Motorola, Inc., pp. 52 through 56 and 58.

"International Rectifier Application Note 973", (Date Unknown) Peter N. Wood, pp. 229 through 236.

"1.9 Electronic ballast for flourescent lamps", Siemens (?), (Date Unknown) p. 34.

*Primary Examiner*—Robert J. Pascal
*Assistant Examiner*—Haissa Philogene
*Attorney, Agent, or Firm*—Scott W. McLellan

[57] ABSTRACT

Two methods are disclosed for providing a warm-up or pre-heat period for a gas-discharge lighting system, such as a fluorescent light. One method provides current to the lamp for a predetermined period of time to heat the filaments therein without significant ionization of the lamp. The second method provides current to the lamp to heat the filaments without significant ionization of the lamp until the voltage across the filament reaches a predetermined voltage. After the lamp is pre-heated, the current is increased to ionize the lamp.

8 Claims, 2 Drawing Sheets

METHOD FOR PRE-HEATING A GAS-DISCHARGE LAMP

BACKGROUND OF THE INVENTION

CROSS-REFERENCE TO RELATED APPLICATION

This application is related to a patent application titled "Method Of Operating A Gas-Discharge Lamp And Protecting Same From Overload", by J. K. Moriarty, Ser. No. 08/171,501, filed simultaneously with, and assigned to the same assignee, as this application.

Field of the Invention

This invention relates to ballasts for gas discharge lamps and the like and, more particularly, to controlling electronic ballast circuits to pre-heat gas-discharge lamps having filaments therein.

Description of the Prior Art

Gas discharge lighting, such as sodium vapor or fluorescence lighting, is used where the higher efficiency of gas discharge lighting over incandescent lighting is important, such as in office buildings where there may be thousands of lighting fixtures.

Each gas discharge lighting fixture or system has a ballast which controls the operation of one or more gas discharge lamp therein. The ballast serves to provide the correct voltage and current to the lamp when the fixture is first turned on and thereafter. The ballast is recognized as the component most needing improvement to increase the efficiency of gas discharge lighting.

The initial ballast designs were large transformers that operated at the power line frequency (e.g., 50 or 60 Hz) and were heavy and dissipated a lot of power. These were replaced with electronic ballasts that still relied on transformers but operated at higher frequencies (tens of KHz) to achieve better efficiencies, reduced weight and size (the transformers could be much smaller when operated at the higher frequencies). However, the transformers reduce the efficiency of the ballast. Moreover, transformer-based electronic ballast arc difficult to design, relying on the electromagnetic properties of the transformer to achieve the desired voltage and current to the gas discharge lamp on startup and thereafter. Usually, these designs are a compromise between the startup and operating voltages/currents, leading to the possible reduction the life of the gas discharge lamp and/or efficiency reduction of the overall lighting system.

Thus, it is desirable to provide a ballast design that has better efficiency that prior art ballast designs.

Further, it is desirable to provide a ballast design that can provide a pre-heat capability to more efficiently start the gas discharge lamp.

SUMMARY OF THE INVENTION

These and other aspects of the invention are generally provided for in a gas discharge lighting system having an inductor and at least two capacitors in combination with a gas discharge lamp having at least one filament. The inductor and capacitors form a resonant system, the resonant frequency thereof being dependent upon whether the lamp is ionized or not. The method is characterized by the steps of: driving the lamp, inductor, and capacitor combination with a signal of a first polarity; measuring the lamp filament current; and inverting the polarity of the signal when the current exceeds a predetermined level. The steps of measuring the current and inverting the polarity of the signal are repeated for a predetermined time. The predetermined level of current is insufficient to ionize the lamp and the predetermined length of time is one-half the inverse of a minimum frequency greater than the ionized resonant frequency but less than the nonionized resonant frequency.

The above aspects of the invention may also be generally provided for in a gas discharge lighting system as described above, characterized by the steps of: driving the lamp, inductor, and capacitor combination with a first current having a frequency approximately equal to the nonionized resonance frequency; measuring the voltage across the lamp filament; and driving the lamp, inductor, and capacitor combination with a second current having a frequency approximately equal to the nonionized resonance frequency when the voltage across the filament exceeds a predetermined voltage. The first current is insufficient to ionize the lamp and the second current is sufficient to ionize the lamp.

BRIEF DESCRIPTION OF THE DRAWING

The foregoing features of this invention, as well as the invention itself, may be more fully understood from the following detailed description of the drawings, in which.

DETAILED DESCRIPTION

For the foregoing discussion, fluorescent lamps are used in the exemplary embodiments of the invention. It is understood that the invention is applicable to gas discharge lamps in general, such as mercury and sodium vapor lamps.

Figure 1:
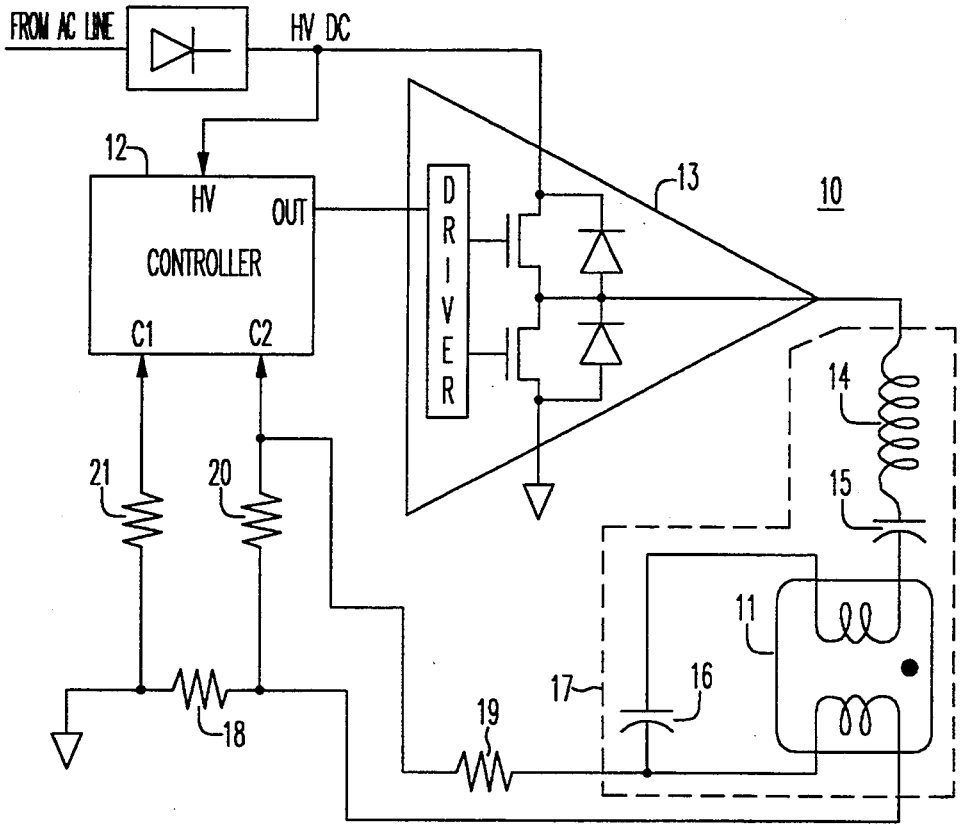
FIG. 1 is a simplified diagram of an exemplary gas-discharge lighting system having a controller, in accordance with an embodiment of the invention.

Referring to FIG. 1, an exemplary gas-discharge lighting system 10 is diagramed. In general, the system 10 can be thought of as a lamp 11 and the remaining circuitry being what is commonly known as a ballast (not numbered), here an electronic ballast. In this exemplary embodiment, the system 10 has a controller 12 with a power amplifier 13 driving a combination of an inductor 14, two capacitors 15, 16 and the lamp 11. The capacitors 15, 16 and inductor 14 are disposed in series with the filaments (not numbered) within lamp 11. This allows the combination of lamp 11, capacitors 15, 16 and inductor 14 to form a resonant circuit 17, the resonant frequency of which dependent upon whether the lamp is ionized (hot) or nonionized (cold). For purposes here, the capacitance of capacitor 15 is much larger than the capacitance of capacitor 16 such that when the lamp 11 is nonionized, the resonant frequency is substantially determined by the capacitor 16 and inductor 14. When the lamp 11 is ionized, substantially all the current is flowing between the filaments in lamp 11, effectively shunting capacitor 16. Thus, as the lamp 11 warms up, the resonant frequency shifts downward from the nonionized resonant frequency to an ionized resonant frequency substantially set by inductor 14 and capacitor 15. The Q of the resonant circuit 17 also varies depending on the ionization level of the lamp 11. When the lamp 11 is nonionized, the Q is high (the filaments have relatively low resistances) and when the lamp is ionized, the Q is lowered. This makes it more critical to control the frequency of a signal from the power amplifier 13 when the lamp 11 is nonionized so that enough power is transferred to the lamp 11 to start it, as will be described below. It is also critical to not drive the resonant circuit 17 at resonance at any time. Thus, the frequency of the signal from the power amplifier 13 is controlled to avoid operating at resonance.

Generally, this invention describes an exemplary method of pre-heating the lamp 11 prior to the normal start-up of the lamp 11. During all phases of the lighting system's 10 operation and for purposes of describing the invention, the resonant circuit 17, including lamp 11, is driven with a signal from power amplifier 13. When the system 10 is first started and for a predetermined amount of time, the signal has a frequency approximately equal to the nonionized resonance frequency. One method of setting the frequency of the signal is by repeatedly changing the polarity of the signal when the signal current exceeds a predetermined amount as determined by measuring the voltage across resistor 18. The amount of current is limited such that the lamp 11 does not ionize the lamp significantly but instead just heats the filaments therein. The predetermined amount of time is made long enough to assure sufficient heating of the filaments in lamp 11 for proper operation of the lamp.

Alternatively, the voltage across a filament in the lamp 11 may be measured to determine when pre-heating has completed. Since the lamp filament has a strong positive temperature coefficient, when the filament warms up, the voltage across the filament rises to a predetermined voltage when the filament is fully heated. Then the lamp 11 begins the normal start-up sequence as described below.

The start-up sequence begins by amplifier 13 driving the resonant circuit 17 with signal having a frequency near the nonionized resonant frequency and with sufficient current to ionize the lamp 11. As the lamp 11 ionizes, the signal frequency sweeps toward the ionized resonant frequency until reaching a predetermined frequency differing from the ionized resonant frequency. By limiting the signal frequency to above the ionized resonant frequency, the power delivered to the lamp 11 is limited. Additionally, by increasing the signal frequency, the amount of power delivered to the lamp 11 decreases, useful in diming applications. Still further, if an overload condition occurs in the resonant circuit (in this example when the amount of current in the lamp 11 exceeds a predetermined amount, the signal frequency is increased, thereby protecting the lighting system 10 from damage.

In more detail, the controller 12 provides a signal that is amplified by power amplifier 13 to drive the resonant circuit 17. The controller 12 will be discussed in more detail below, but it is sufficient for purposes here that the controller measures the current in the lamp 11 (the current from the resonant circuit 17) by evaluating the voltage drop across series resistor 18. In essence, the controller acts as a relaxation oscillator. A signal of a first polarity from the controller 12 is amplified by power amplifier 13 and applied to the resonant circuit 17. When the current through resistor 18 transitions a predetermined level of current with the right slope, the controller inverts the signal. This is repeated, forming an oscillation. (While the process of detecting a transition of a predetermined current level by the lamp 11 current with the right slope is discussed in detail below, for purposes of this discussion it is detecting when the lamp 11 current transitions a predetermined current level having a polarity opposite the polarity of the slope of the lamp 11 current at the time of the transition.) When the lamp 11 is nonionized, the oscillation frequency is near the nonionized resonance frequency of the resonant circuit 17, as discussed above.

As the lamp 11 ionizes more fully from the cold (nonionized) start, the amount of time for the current in the lamp 11 to transition the predetermined current level lengthens. This makes the oscillation frequency shift downward until a maximum time between changes in signal polarity occurs (referred to here as a time-out, setting the minimum oscillation frequency. This minimum frequency is set to be greater than the ionized resonant frequency of the resonant circuit 17. Thus, the maximum possible energy transfer from the power amplifier 13 to the lamp 11 can be avoided.

It is noted that by shifting the oscillation frequency up further away from the resonant frequency, less energy is transferred from the power amplifier 13 to the lamp 11. If a fault is detected by the controller 12 as indicated by the current in the lamp 11 exceeding a predetermined amount (an overload), the polarity of the signal from the controller 11 changes polarity. Since, during normal operation, the overload current limit is not reached at the minimum oscillation frequency, the detection of an overload condition occurs before the time-out, thus causing the oscillation frequency to increase away from the resonant frequency of the resonant circuit 17. As discussed above, this reduces the power delivered to the lamp 11, protecting it and the amplifier 13 from damage during an overload.

Amplifier 13 is shown having two output transistors and a driver (not numbered). While detailed understanding is not important for understanding the invention, the amplifier 13 will be described here simply. For purposes here, the driver assures that both output transistors are not on at the same time; a dead time is forced between the on time of the transistors. To minimize power dissipation in the output transistors, the transistors are switched on when the drain-source voltage of the transistor is near zero volts, known as zero voltage switching. The amplifier 13 is powered from a high voltage DC bus (HV DC) that derives its voltage from the AC power line, making the amplitude of the signal from the amplifier 13 proportional to the voltage on the HV DC bus. As will be discussed below, the power delivered to the lamp 11 is proportional to the signal amplitude and, without compensation, the light output of the lamp will change with varying AC line voltage.

As will be discussed in more detail below, resistor 19 may be provided as a means for measuring the voltage across a filament in the lamp 11. This feature is utilized for pre-heating the lamp 11 before starting the lamp 11, as described above. Two methods are provided for controlling the pre-heat of the lamp 11: passing current through the filaments at a level insufficient to significantly ionize the lamp 11 for a predetermined amount of time; or passing the current through the filaments until the voltage across one or more of the filaments reaches a predetermined level. Using either technique, the preheating of the filaments prior to the above-described start-up and operating states described above, allows for longer lamp 11 life. Because tungsten filaments have a strong positive temperature coefficient, the voltage across a filament is a good indicator of temperature of the filament. Hence, resistor 19 is optionally provided to allow for measuring the voltage across the filament. The circuitry in the controller 12 for measuring the voltage will be explained in more detail below.

Figure 2:
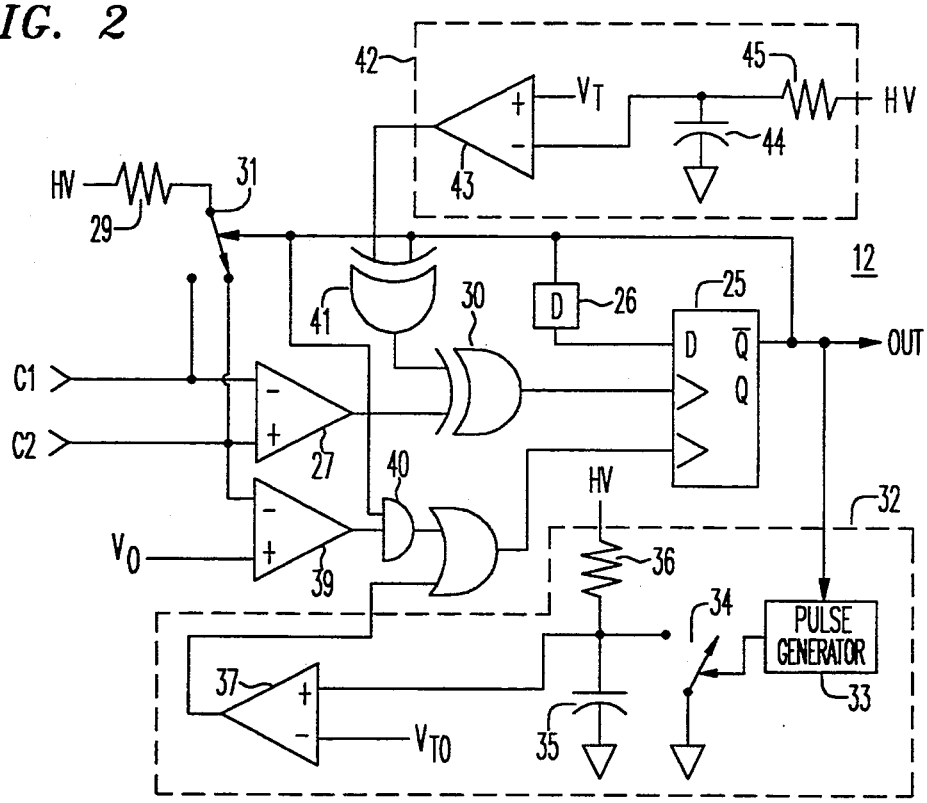
FIG. 2 is a simplified schematic diagram of the controller shown in FIG. 1, in accordance with the embodiment of the invention.

Shown in FIG. 2 is an exemplary and simplified circuit diagram of the controller 12 (FIG. 1 ). For purposes of this discussion, delay circuitry 42 is ignored and exclusive-OR gate 41 does not invert. Delay circuit 42 and gate 41 will be discussed below in connection with the pre-heating of the lamp 11. At the core of the controller 12, a clocked flip-flop 25 generates a signal that drives power amplifier 13 (FIG. 1). Each time the flip-flop 25 is clocked, the output ($\overline{Q}$) thereof is inverted (toggled). To avoid multiple transitions in the output of the flip-flop 25 due to "bounce" in the clock signal source, a delay 26 is provided between the $\overline{Q}$ output and the D input of the flip-flop 25. The amount of delay is sufficient to assure that the clock signal to the flip-flop 25 has stabilized before the D input receives a new value.

Flip-flop 25 is clocked from one of three sources depending on the operational state of the lighting system 10 (FIG. 1). During the start-up state, as discussed above, comparator 27 clocks the flip-flop 25 when the current through the lamp 11 (FIG. 1) passes through a predetermined current level, as sensed across current sensing resistor 18 (FIG. 1). Resistor 29 adds an offset current into the resistors 18, 20, 21 (FIG. 1) to establish the level of voltage across resistor 18 that will switch the comparator 27, i.e., resistor 29, in combination with resistors 18, 20 and 21, substantially determines the switching current level in the lamp 11. Exclusive OR (EX-OR) gate 30 and switch 31 invert the output of the comparator 27 and redirects the offset current from resistor 29 into the comparator 27 input, respectively, for clocking the flip-flop 25 for both positive and negative lamp current transition polarities. The flip-flop 25, delay 26, EX-OR gate 30 and comparator 27 cooperate to emulate a window comparator such that flip-flop 25 toggles when the polarity of the slope of the voltage across resistor 18 is opposite the polarity of the desired threshold voltage at the time the voltages are approximately the same, as described above.

Figure 3:
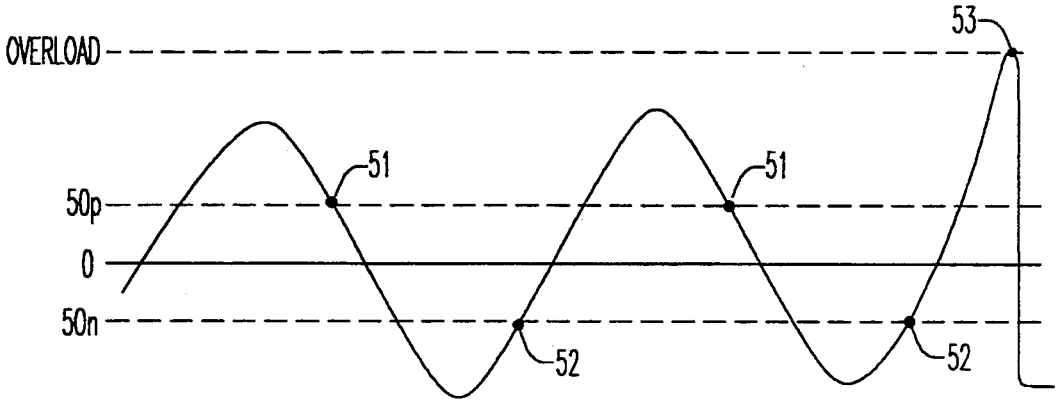
FIG. 3 is a simplified plot (not to scale) of the current in the gas-discharge lamp of FIG. 1 during start-up of the lamp.

Operationally, the flip-flop 25 outputs a first polarity signal which, after amplification by power amplifier 13, the current through the lamp 11 increases until the voltage drop across resistor 18 with the correct slope transitions a value determined by resistor 20 or 21 (depending on the position of switch 31) and resistor 29, switching the output of comparator 27. This, in turn, toggles flip-flop 25 and the above process repeats. This is illustrated in FIG. 3. The depicted waveform is an illustrative example of the current in the lamp 11 as represented by voltage across resistor 18 (the real waveform is more complicated but it is sufficient here that the waveform be depicted sinusoid-like). As shown, the current in lamp 11 (and then 18) voltage across resistor 18 is symmetric about zero (0) and exceeds the thresholds **50*p*, 50*n*, illustrating the operation of the lamp system 10 (FIG. 1) in the start-up mode. As the waveform slopes negatively, the positive threshold 50*p* is transitions at point 51, toggling flip-flop 25 (FIG. 2). Similarly, when the waveform slope is positive, the negative threshold 50*n* is transitioned at point 52, again toggling flip-flop 25. By virtue of the resonant circuit 17 (FIG. 1), the current in the lamp 11 continues to extend beyond the thresholds 50*p* and 50*n*. Because of this and the window comparison function of the flip-flop 25 and comparator 27 combination, the closer to zero the thresholds are, the more the peak current in the lamp 11 becomes and, conversely, the higher the thresholds, the less the peak current in lamp 11. By making the threshold voltage 50*p*, 50*n* dependent on the HV bus voltage (via resistor 29 as shown in FIG. 2), the power delivered to the lamp 11** is less dependent upon the HV bus voltage during start-up.

Returning to FIG. 2 and as discussed above, during normal operation of the lighting system 10 after start-up, the current through the lamp 11 is insufficient to cause comparator 27 to trigger. Thus, another means is needed to keep the output of the controller 12 changing without intervention by comparator 27. That means is time-out circuit 32 which assures that the flip-flop 25 is toggled at a minimum rate or frequency as substantially established by the delay period of the time-out circuit 32. Time-out circuit 32 utilizes a combination of a pulse generator 33, capacitor 35, resistor 36 and a comparator 37 to set the delay thereof. The pulse generator 33 generates a short pulse to close switch 34 each time flip-flop 25 toggles. Switch 34 discharges capacitor 35 to start the time-out delay period. As current from resistor 36 charges capacitor 35, voltage on capacitor 35 increases until a predetermined voltage is reached thereon, triggering comparator 37 to toggle flip-flop 25. The predetermined voltage is substantially equal to $V_{TO}$. Thus, the time-out delay period is substantially determined by the values of capacitor 35, resistor 36, the time-out trigger voltage $V_{TO}$, and the voltage of the high voltage power supply rail, HV. Because the current from the resistor 36 is dependent upon the voltage on the high-voltage rail, as the voltage increases, the time-out delay period decreases. To compensate for an increased signal level from amplifier 13 as the AC line voltage increases, as discussed above, the frequency of the signal to the lamp 11 increases away from the resonant frequency of the resonant circuit 17 (FIG. 1). Similarly, the frequency decreases as the AC line voltage decreases. Thus, the power delivered to the lamp 11 remains substantially the same with varying line voltage.

It is understood that resistor 36 may be coupled to a fixed voltage supply instead of the HV bus if the variable time-out delay feature is not desired.

Comparator 39, ORed together with the output of the time-out circuit 32, clocks flip-flop 25 if the voltage of input C2 exceeds $V_o$. Comparator 39 serves as the overload detector in combination with resistor 18. If the offset current from resistor 29 were allowed to flow through resistor 20 (FIG. 1), then the current limit sensing would be corrupted. Hence, AND gate 40 enables the output of comparator 30 when the output of flip-flop 25 configures switch 31 to couple resistor 29 to resistor 21. If the current in lamp 11 (as shown on FIG. 3) exceeds the OVERLOAD current limit (53), then the flip-flop 25 is immediately toggled. This has the effect of raising the frequency of the lamp 11 current, decreasing the power delivered to lamp 11, as described above. It is noted that comparator 39 may be a simple bipolar transistor, making $V_o$ about 0.7 volts.

Figure 4:
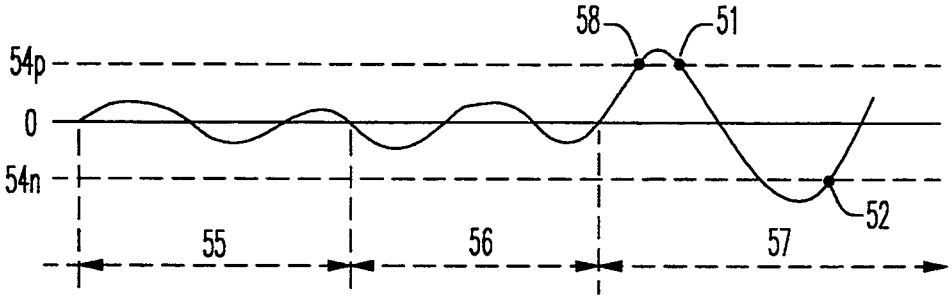
FIG. 4 is a simplified plot (not to scale) of the current in the filaments in the lamp of FIG. 1 during pre-heat of the lamp, according to one embodiment of the invention.

As discussed above, controlling the pre-heating of the lamp 11 may be accomplished in two exemplary embodiments of the invention: monitoring the filament voltage; or maintaining a low current through the filaments for a predetermined amount of time. The first embodiment, referred to here as the filament voltage method, relies on resistor 19 (FIG. 1) to contribute voltage to the C2 input on the controller 12. In essence, the value of the resistors 18, 19 and 20 are set such that without resistor 19 the voltage drop across resistor 18 is insufficient to cause comparator 27 to trigger when the lamp 11 is nonionized. As mentioned above, if flip-flop 25 is not toggled within the time-out period set by time-out circuit 32, then circuit 32 clocks the flip-flop 25, thus inverting the output signal from controller 12. This continues indefinitely. Referring to FIG. 4, an exemplary operation of the filament voltage method pre-heat of the lamp 11 is shown with a plot of the voltage on controller 12 input C2. Referring also to FIGS. 1 and 2, when the lighting system 10 is first turned on (the HV bus achieves full voltage), a pulse is applied to resonant circuit 17 from the controller 12 and amplifier 13 to form a damped exemplary sinusoid for the time period 55. At the end of time period 55, time-out circuit 32 causes flip-flop 25 to toggle since the voltage on C2 did not reach thresholds 54*p*, 54*n* (which corresponds to the current limits 50*p*, 50*n*, respectively, in FIG. 3) to trigger comparator 27. Thus, at the beginning of time period 56, a pulse is applied to resonant circuit 17 from controller 12/amplifier 13 and the damped sinusoid again occurs but with greater amplitude than during the period 55. This is in response to the filament in lamp 11 heating up and, because of the strong positive temperature coefficient of the filament resistance, the voltage thereon rapidly increases as the filament gets hotter. However, the amplitude of the sinusoid is still insufficient to reach the thresholds 54*p*, 54*n*, and the time-out circuit 32 again causes a pulse to be applied to the resonant circuit 17 to begin time period 57. Now the sinusoid does exceed the threshold 54*p*, causing comparator 27 to trigger and starting the start-up process with the voltage on C2 triggering comparator 27 at points 51 and 52 as discussed above.

It is noted that an exemplary three "kicks" of the resonant circuit 17 were shown to pre-heat the lamp 11. In practice, many such "kicks" are needed to pre-heat the lamp 11. Also, the sinusoid shown will be much more distorted than as shown. Typically, the current flowing in the lamp 11 during time periods 55 and 56 are insufficient to cause significant ionization of the lamp 11.

Figure 5:
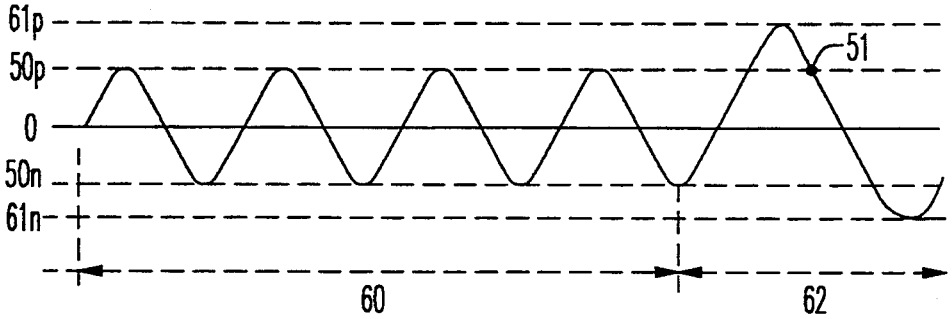
FIG. 5 is a simplified plot (not to scale) of the current in the filaments in the lamp of FIG. 1 during pre-heat of the lamp, according to another embodiment of the invention.

The second embodiment of the pre-heating of lamp 11, the time-limited low current approach, requires additional circuitry added to the controller 12 and resistor 19 is removed. In FIG. 2, gate 41 and delay circuit 42 are used to provide a low current to the lamp 11 for a predetermined period of time as determined by the delay 42. During the pre-heat period, EX-OR gate 41 inverts the output of flip-flop 25 to make the combination of comparator 27, flip-flop 25, delay 26 and EX-OR 30 operate as a threshold detector instead of as a window comparator (i.e., slope polarity dependent), as described above. Upon the initial power-up of the lighting system 10, capacitor 44 is discharged, making the output of comparator 43 "high", causing EX-OR gate 41 to be an inverter. This continues until current from resistor 45 sufficiently charges capacitor 44 to trigger comparator 43, returning the gate 41 to non-inverting. Thus, delay circuit 42 causes the combination of comparator 27, EX-OR gate 30, flip-flop 25 and delay 26 a threshold detector until circuit 42 times out and the combination reverts to the window comparator mode. The effect of this is shown in FIG. 5. Here, the current in lamp 11 is shown being limited to essentially a first predetermined current limit, here the current limit 50*p*, 50*n*, for the predetermined period of time shown as time period 60. After the predetermined period of time 60, the controller 12 begins the start-up process as described above and as indicated in FIG. 5 as time period 62, corresponding to that shown in FIG. 3. It is noted that the current limits 50*p*, 50*n*, in period 62 limit the current peak to a second predetermined current level or limit 61*p*, 61*n* by virtue of the window comparison function in the controller 12, as discussed above. Preferably, the first predetermined current is low enough as to not cause significant ionization of the lamp 11 and the second current level is at least four times the first current level. It is also understood that a combination of the two techniques described above may be used, such as using the low current time-limited approach combined with measuring the voltage across the filament in the lamp 11.

Exemplary Embodiment

The lighting system 10 of FIGS. 1 and 2 have been reduced to practice in a 30 watt fluorescent light for both exemplary embodiments of the invention using the following component values:

| | filament voltage method | time-limited low current method |
|---|---|---|
| inductor 14 | 500 μH | 500 μH |
| capacitor 15 | 100 nF | 100 nF |
| capacitor 16 | 10 nF | 10 nF |
| resistor 18 | 0.5 Ω | 0.5 Ω |
| resistor 19 | 2000 Ω | not used |
| resistors 20, 21 | 1000 Ω | 1000 Ω |
| resistor 29 | 1 MΩ | 1 MΩ |
| time-out delay | 12 μs. | 12 μs. |
| HV bus | 150 V. | 150 V. |
| overload current limit | 1.5 A. | 1.5 A. |
| current threshold 50p, 50n | 200 mA. | 200 mA. |

Having described the preferred embodiment of this invention, it will now be apparent to one of skill in the art that other embodiments incorporating its concept may be used. Therefore, this invention should not be limited to the disclosed embodiment, but rather should be limited only by the spirit and scope of the appended claims.

I claim:

1. A method of preheating a gas discharge lamp in a gas discharge lighting system having an inductor and at least two capacitors in combination with the gas discharge lamp having at least one filament, the inductor and capacitors forming a resonant system, the resonant frequency thereof being dependent upon whether the lamp is ionized or nonionized, characterized by the steps of:

A) driving the lamp, inductor, and capacitor combination with a signal of a first polarity;

B) measuring a current in the lamp filament;

C) inverting the polarity of the signal when the current exceeds a predetermined level;

D) repeating steps B and C for a predetermined time;

wherein the predetermined level of current is insufficient to ionize the lamp; and wherein the predetermined length of time is one-half the inverse of a minimum frequency greater than the ionized resonant frequency but less than the nonionized resonant frequency.

2. The method as recited in claim 1, wherein the current in the lamp filament is measured by evaluating the voltage dropped across a resistor disposed in series with the filament.

3. The method as recited in claim 1, wherein the current in the lamp filament is measured by evaluating the voltage dropped across the filament of the lamp.

4. A method of preheating a gas discharge lamp in a gas discharge lighting system having an inductor and at least two capacitors in combination with a gas discharge lamp having at least one filament, the inductor and capacitors forming a resonant system, the resonant frequency thereof being dependent upon whether the lamp is ionized or nonionized, characterized by the steps of:

driving the lamp, inductor, and capacitor combination with a first current having a frequency approximately equal to the nonionized resonance frequency;

measuring a voltage across the lamp filament in response to the first current;

driving the lamp, inductor, and capacitor combination with a second current having a frequency approximately equal to the nonionized resonance frequency when the voltage across the filament exceeds a predetermined voltage;

wherein the first current is insufficient to ionize the lamp and the second current is sufficient to ionize the lamp.

5. The method as recited in claim 4, wherein the second current is at least four times the first current.

6. A method of operating gas discharge lighting system having an inductor and at least two capacitors in combination with a gas discharge lamp having at least one filament and two electrodes, the inductor and capacitors forming a resonant system, the resonant frequency thereof being dependent upon whether the lamp is nonionized or ionized, characterized by the steps of:

A) driving the lamp, inductor, and capacitor combination with a signal of a first polarity;

B) measuring a current in the lamp filament;

C) inverting the polarity of the signal when the current exceeds a first predetermined level, that level of current being insufficient to ionize the lamp;

D) repeating steps B and C for a predetermined time;

E) measuring current in the lamp between the electrodes;

F) inverting the polarity of the signal when the current transitions a second predetermined current level;

G) repeating steps E and F;

wherein if the signal remains of one polarity for longer than a predetermined length of time, the polarity of the signal is inverted; and wherein the predetermined length of time is one-half the inverse of a minimum frequency greater than the ionized resonant frequency but less than the nonionized resonant frequency.

7. The method as recited in claim 6, wherein the second predetermined level is approximately the same as the first predetermined level.

8. A method of operating gas discharge lighting system having an inductor and at least two capacitors in combination with a gas discharge lamp having at least one filament and two electrodes, the inductor and capacitors forming a resonant system, the resonant frequency thereof being dependent upon whether the lamp is ionized or nonionized, characterized by the steps of:

A) driving the lamp, inductor, and capacitor combination with a first signal having a frequency approximately equal to the nonionized resonance frequency;

B) measuring a voltage across the lamp filament in response to the first signal;

C) driving the lamp, inductor, and capacitor combination with a second signal of a first polarity when the voltage across the lamp filament exceeds a predetermined voltage;

D) measuring the current of the second signal;

E) inverting the polarity of the signal when the current exceeds a predetermined level;

F) repeating steps D and E;

wherein if the signal remains of one polarity for longer than a predetermined length of time, the polarity of the signal is inverted; and wherein the predetermined length of time is one-half the inverse of a minimum frequency greater than the ionized resonant frequency but less than the nonionized resonant frequency.

* * * * *